US005138740A

United States Patent [19]

Goodnow et al.

[11] Patent Number: 5,138,740

[45] Date of Patent: Aug. 18, 1992

[54] DOCTOR BLADE AND BLADE TO BLADE CONNECTOR FOR PULL THROUGH BLADE TRANSFER SYSTEM

[75] Inventors: Ronald F. Goodnow, Leicester; Robert A. Reid, Charlton City, both of Mass.

[73] Assignee: Thermo Electron-Web Systems, Inc., Auburn, Mass.

[21] Appl. No.: 533,378

[22] Filed: Jun. 5, 1990

[51] Int. Cl.[5] ..... B08B 1/02

[52] U.S. Cl. ..... 15/256.51; 15/256.53; 24/573.1; 100/174; 118/652; 162/281; 403/286; 403/292

[58] Field of Search ..... 15/256.5, 256.51, 256.53; 249/219.1; 100/174; 355/299; 474/218, 253; 162/281; 101/157, 169, 425; 118/652; 83/661; 403/286, 292, 300, 393, 381, 304, 353, 373, 374; 24/20 R, 21, 20 EE, 31 B, 23 EE, 3 K, 38, 22, 25, 573.1, 573.2, 573.3; 226/92

[56] References Cited

U.S. PATENT DOCUMENTS

| | | | |
|---|---|---|---|
| 361,536 | 4/1887 | Miller | 76/29 |
| 837,439 | 12/1906 | Wallace | 83/838 |
| 853,282 | 5/1907 | Wallace | 83/838 |
| 2,664,792 | 1/1954 | Cook | 15/256.53 |
| 3,995,685 | 12/1976 | Stanko | 403/381 X |
| 4,528,067 | 7/1985 | Hedberg | 162/281 |
| 4,576,321 | 3/1986 | Marson | 226/92 X |
| 4,685,368 | 8/1987 | Gardner | 474/253 X |
| 4,691,406 | 9/1987 | Goodnow et al. | 15/256.53 |
| 4,802,928 | 2/1989 | Dunlap | 15/256.53 |
| 5,066,364 | 11/1991 | Goodnow et al. | 15/256.53 X |

*Primary Examiner*—Harvey C. Hornsby
*Assistant Examiner*—C. Cooley
*Attorney, Agent, or Firm*—Samuels, Gauthier & Stevens

[57] ABSTRACT

In a pull through doctor blade transfer system, the blade ends are slotted at their working edges. The slots are arranged and configured to accept complimentarily shaped portions of a connecting link used to detachably connect the trailing end of a spent or worn blade to the leading end of a fresh blade.

5 Claims, 3 Drawing Sheets

DOCTOR BLADE AND BLADE TO BLADE CONNECTOR FOR PULL THROUGH BLADE TRANSFER SYSTEM

This invention relates to doctoring apparatus wherein flexible elongated doctor blades are advanced longitudinally across the surfaces being doctored.

U.S. Pat. No. 4,691,406 discloses a doctoring apparatus of the above-mentioned type. The doctor blade has a length greater than the width of the surface being doctored. A blade holder applies an intermediate portion of the blade to the surface being doctored. The blade is movable longitudinally through the blade holder, and has continuing portions which extend in opposite directions beyond the ends of the holder to pay off and take up reels. Clamps act on the continuing blade portions. The clamps are adjustable between closed settings preventing relative movement between them and the blade, and open settings permitting such relative movement. A drive reciprocates either the blade holder or the clamps. The clamps are opened and closed in timed sequence with their reciprocation, or reciprocation of the blade holder, to achieve longitudinal shifting of the blade in a selected direction across the doctored surface, from one to the other of the reels.

This type of "pull through" blade transfer system maximizes efficiency by eliminating production losses normally associated with changing conventional blades. By employing coils of blade stock rather than "cut-to-length" blades, a nearly continuous mode of operation is attained.

SUMMARY OF THE INVENTION

An objective of the present invention is to further optimize the benefits of pull through blade transfer systems by keeping the time required to change blade coils to an absolute minimum.

A more specific object of the present invention is the provision of an efficient means for detachably connecting the trailing end of a spent coil to the leading end of a fresh coil.

A companion objective is the provision of a connecting device which is unaffected by the gradual reduction in the width of the blade stock which results from successively regrinding the working edge.

DETAILED DESCRIPTION OF ILLUSTRATED EMBODIMENT

Figure 1:
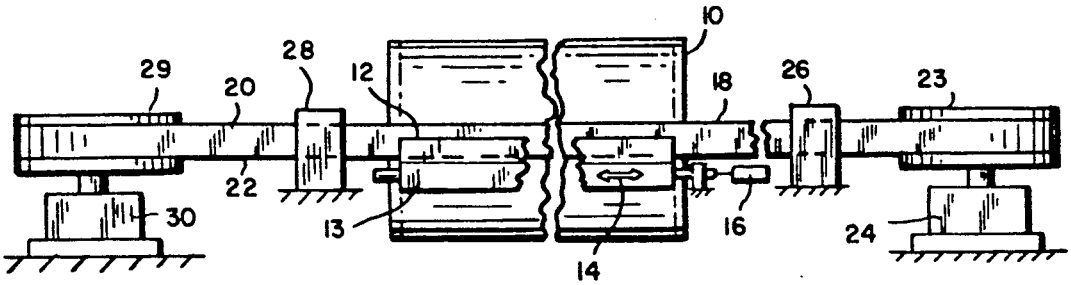
FIG. 1 is a schematic illustration of a pull through doctor blade transfer system.
Figure 3:
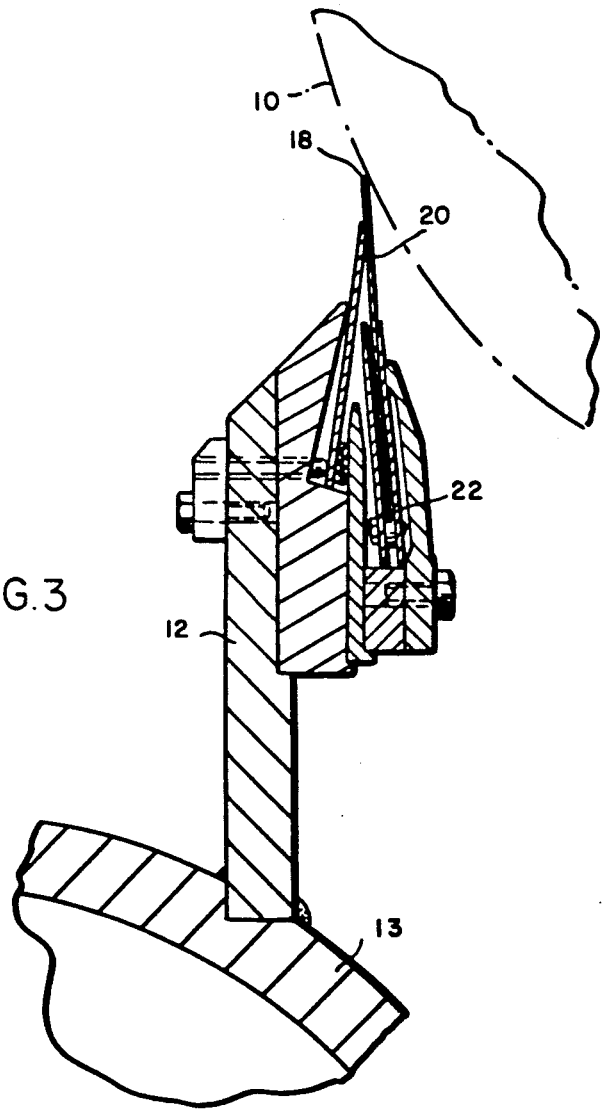
FIG. 3 is an enlarged partial cross sectional view taken along line 3—3 of FIG. 2.
Figure 2:
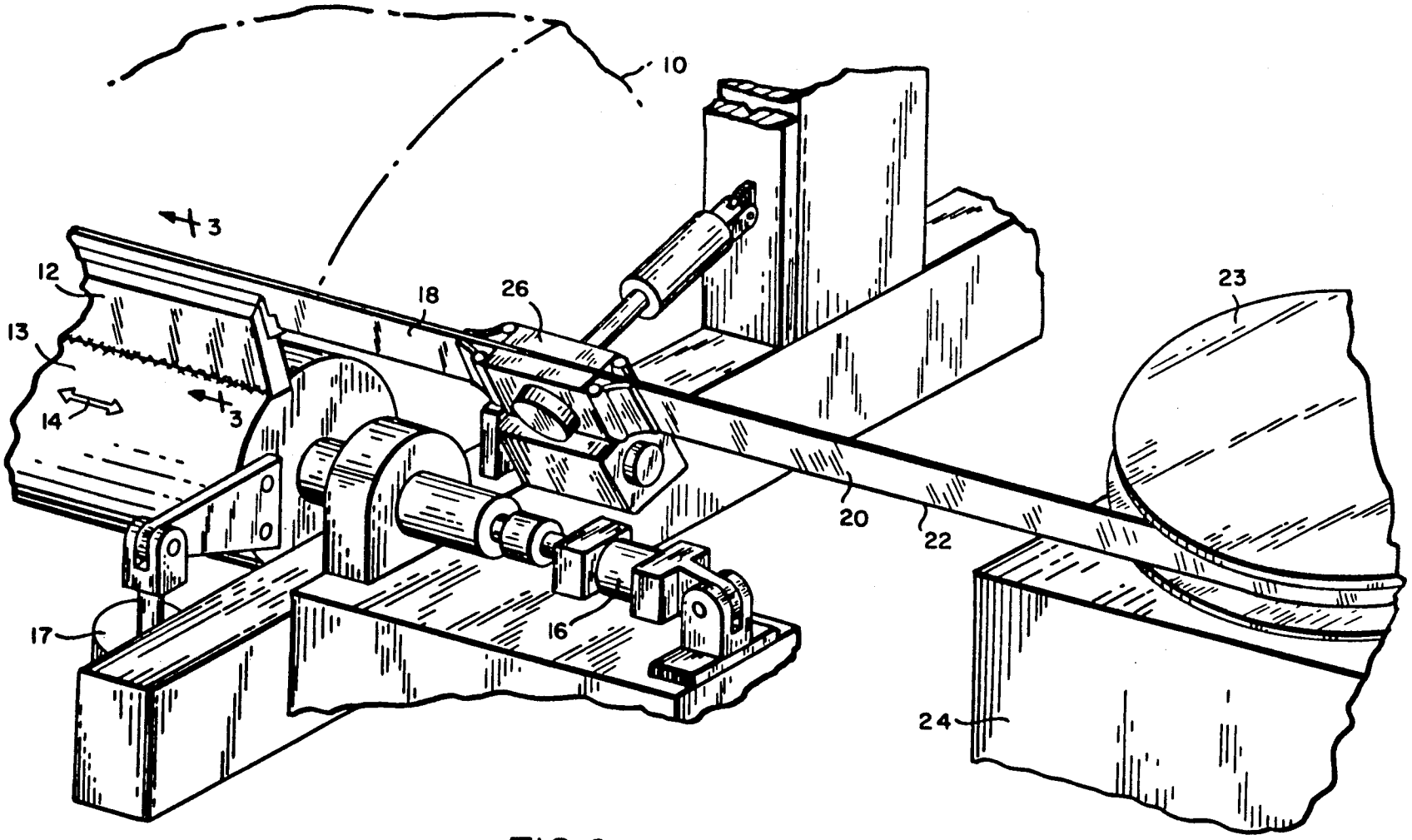
FIG. 2 is a three dimensional view of a portion of the apparatus shown in FIG. 1.

Referring initially to FIGS. 1-3, a pull through doctor blade transfer system is shown doctoring a rotating cylinder 10. A doctor blade holder 12 is mounted on a doctor back 13 and is positioned adjacent to the cylinder 10. The doctor back is adapted to be reciprocated to and fro in the direction of arrow 14 by any convenient means, one example being a double acting piston-cylinder unit 16. The doctor back is rotatably adjusted by means of another piston-cylinder unit 17 to urge the holder 12 towards the cylinder 10, thus applying the working edge 18 of an elongated flexible doctor blade 20 to the roll surface. The doctor blade has a bottom edge 22 which is parallel to the working edge 20 and which is supported in the holder 12.

The doctor blade 20 is adapted to be wound into a coil. A cartridge 23 containing a fresh coil is mounted on a payoff reel 24. The leading blade end is then threaded through a first clamp 26, the blade holder 12, a second clamp 28, and is then connected to an empty cartridge 29 mounted on a take up reel 30.

During the doctoring operation, the doctor back 13 and the holder 12 are oscillated by the piston-cylinder unit 16, and the clamps 26,28 are employed in timed sequence with this oscillation to shift the blade longitudinally across the cylinder surface, with blade stock being gradually paid off from cartridge 23 at reel 24 and taken up on cartridge 29 at reel 30. A more detailed description of this procedure is provided in U.S. Pat. No. 4,691,406, the description of which is herein incorporated by reference in its entirety.

When the trailing end of one blade length leaves the cartridge 23 at the pay off reel 24, that cartridge is replaced by another cartridge containing a fresh coil. The leading end of the fresh coil is then advanced to a position directly adjacent to the preceding trailing end, and the two ends are detachably interconnected. This having been accomplished, the doctoring operation is momentarily interrupted while the reels 24,30 are speeded up with the clamps 26,28 open to rapidly traverse the interconnected ends across the cylinder 10. Then, the doctoring operation is continued, and the blade ends are disconnected to allow the cartridge 29 containing the spent coil to be replaced by an empty cartridge to which the fresh leading end is then connected.

Figure 4:
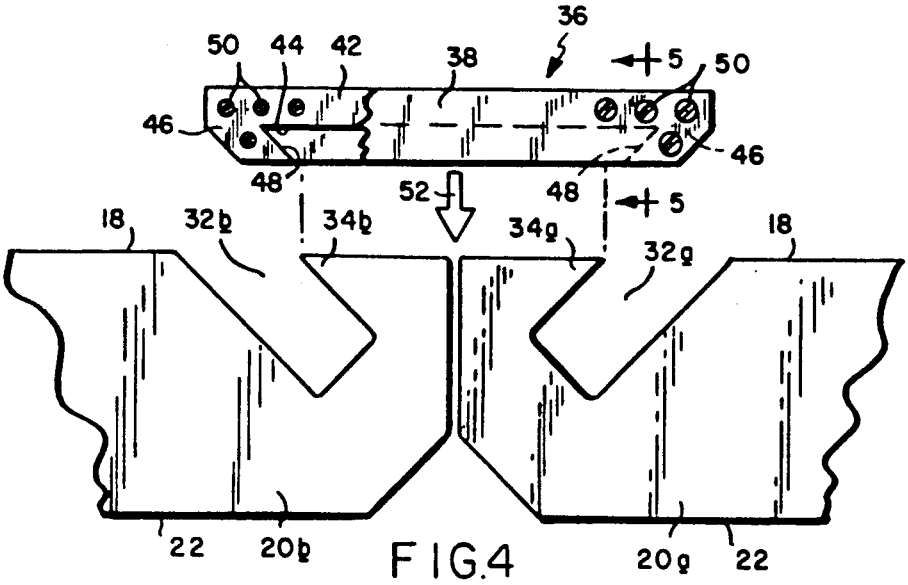
FIG. 4 is an illustration of adjacent trailing and leading blade ends prior to their being interconnected in accordance with the present invention.

Referring now to FIG. 4, the leading blade end 20*a* of a fresh coil is shown positioned directly adjacent to the trailing blade end 20*b* of a spent coil. The blade ends are provided respectively with slots 32*a*,32*b* extending from the working edges 18 towards the bottom edges 22. Each slot intersects the respective working edge at a locking shoulder 34*a*,34*b*. Preferably, the slots 32*a*,32*b* are inclined with respect to the working edges 18. Each slot is preferably inclined towards its respective blade end, with the result that the slot at the trailing end is oppositely inclined with respect to the slots at the leading end.

Figure 5:
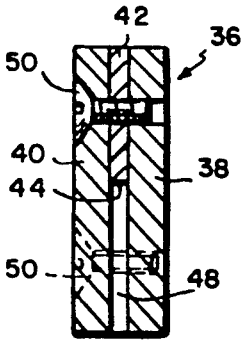
FIG. 5 is an enlarged cross sectional view taken along line 5—5 of FIG. 4.

A connecting link 36 is employed to detachably interconnect the adjacent slotted ends 20*a*,20*b*. With further reference to FIG. 5, it will be seen that the connecting link comprises side plates 38,40 mutually spaced one from the other by a center plate 42 interposed therebetween. The center plate 42 has a thickness which is at least equal to and preferably slightly greater than that of the blade stock. The bottom edge of the center plate is cut away as at 44 to provide leg portions 46 with angled inner edges 48. The side plates 38,40 and the center plate 42 are interconnected by means of machine screws or the like typically depicted at 50.

With the blade ends 20*a*,20*b* positioned as shown in FIG. 4, the connecting link 36 is simply applied to the working edges 18 in the direction indicated by arrow 52. Thereafter, as shown in FIG. 6, the trailing end 20*b* is pulled away from the leading end 20*a*, causing the angled inner edges 48 to interlock with the locking shoulders 34*a*,34*b*.

The clamps 26,28 will be opened to allow the connecting link to pass through them. Because the link sits on the working edges 18 of the interconnected blades, it can pass across the blade holder 12. The doctoring operation can resume as soon as the thus interconnected ends have cleared the blade holder and clamps. Once the connecting link is disengaged, the cartridge containing the spent coil can be replaced by an empty cartridge to which the fresh leading end is then connected.

Figure 6:
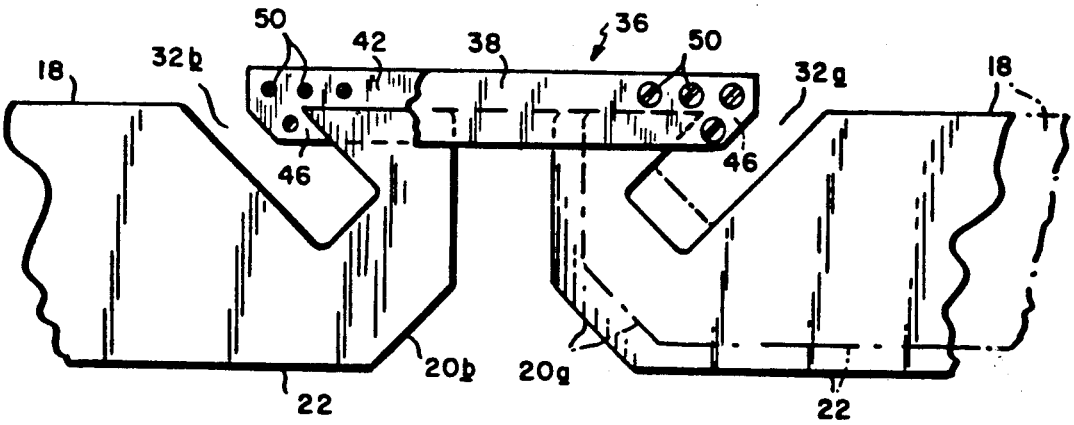
FIG. 6 is an illustration of blade leading and trailing ends detachably interconnected in accordance with the present invention.

As the blades are reground and their widths are gradually reduced, as indicated by the dot-dash lines on the right hand side of FIG. 6, the connecting link will drop towards the bottom blade edges 22, but will otherwise remain entirely operable.

We claim:

1. For use with elongated flexible doctor blades adapted for successive lengthwise advancement across a surface to be doctored, each such blade having a bottom edge supportable in a blade holder and having a working edge parallel to said bottom edge and configured for application against said surface, apparatus for detachably connecting a trailing end of one such blade to a leading end of another such blade, said apparatus comprising:

slots in said blades at the leading and trailing ends thereof, said slots extending from the working edges of said blades towards the bottom edges thereof, each such slot intersecting the respective working edge at a locking shoulder; and a connecting link overlying the working edges of said blades and extending between the leading and trailing ends thereof, said link having locking portions thereof protruding into said slots to engage said locking shoulders.

2. The apparatus of claim 1 wherein said slots are inclined angularly with respect to the working edges.

3. The apparatus of claim 2 wherein the slots at the trailing ends of said blades are inclined oppositely with respect to the slots at the leading ends of said blades.

4. The apparatus of claim 2 wherein said slots extend angularly towards the respective blade ends.

5. The apparatus of claim 1 wherein said connecting link comprises side plates having a center plate interposed therebetween, said center plate having a thickness at least equal to that of said blades, said locking portions comprising legs on said center plate.

* * * * *